United States Patent [19]

Evans

[11] 4,335,791

[45] Jun. 22, 1982

[54] PRESSURE COMPENSATOR AND LUBRICATING RESERVOIR WITH IMPROVED RESPONSE TO SUBSTANTIAL PRESSURE CHANGES AND ADVERSE ENVIRONMENT

[76] Inventor: Robert F. Evans, 631 Honeywood La., La Habra, Calif. 90631

[21] Appl. No.: 251,208

[22] Filed: Apr. 6, 1981

[51] Int. Cl.[3] ..... E21B 10/24

[52] U.S. Cl. ..... 175/228; 308/8.2; 308/187

[58] Field of Search ..... 175/228, 227, 372, 371, 175/339; 308/8.2, 187

[56] References Cited

U.S. PATENT DOCUMENTS

| | | | |
|---|---|---|---|
| 1,532,178 | 4/1925 | Godbold | 175/228 |
| 2,764,103 | 9/1956 | Mercier | 103/223 |
| 2,771,270 | 11/1956 | Selberg | 175/56 |
| 2,906,504 | 9/1959 | Parks | 175/228 |
| 3,007,750 | 11/1961 | Cunningham | 308/187 |
| 3,017,937 | 1/1962 | Bobo | 175/228 |
| 3,048,230 | 8/1962 | Angel | 175/228 |
| 3,105,563 | 10/1963 | Havenaar | 175/337 |
| 3,231,317 | 1/1966 | Dudar | 308/187 X |
| 3,299,973 | 1/1967 | Swart | 175/371 |
| 3,417,901 | 12/1968 | Sands | 222/95 |
| 3,476,195 | 11/1969 | Galle | 175/228 |
| 3,703,213 | 11/1972 | Kammerer | 175/318 |
| 3,719,241 | 3/1973 | Bell | 175/228 |
| 3,721,306 | 3/1973 | Sartor | 175/228 |
| 3,847,234 | 11/1974 | Schumacher, Jr. et al. | 175/228 |
| 3,850,256 | 11/1974 | McQueen | 175/228 |
| 4,014,595 | 3/1977 | Dolezal | 308/8.2 |
| 4,019,785 | 4/1977 | Stinson | 308/8.2 |
| 4,055,225 | 10/1977 | Millsapps | 175/228 |
| 4,181,155 | 1/1980 | Wesselink | 138/30 |
| 4,199,856 | 4/1980 | Farrow | 29/454 |
| 4,202,470 | 5/1980 | Fujii | 222/130 |

OTHER PUBLICATIONS

Chapter 9 in *Drilling Practices Manual,* "Surge and Swab Practices".

*Primary Examiner*—Stephen J. Novosad
*Attorney, Agent, or Firm*—John R. Ley

[57] ABSTRACT

Improved lubricant pressure compensation is achieved in apparatus operative between substantially different changing pressures, for example earth drilling tools and deep submergence ocean machinery, by a flexible hermetically sealed gas-containing chamber which is operative to apply ambient pressures through the interiorly contained gas to a flexible wall membrane which at least partially defines a lubricant containing reservoir. The pressure exerting chamber and the lubricant containing reservoir may both be defined by flexible bladder-like structures with the lubricant containing reservoir contained within the interior of the pressure exerting chamber. In earth drilling apparatus, the reservoir and chamber structures are preferably operatively positioned on a drill collar in adjacency to a rotary drill bit, and lubricant is communicated through passageways from the reservoir to the bearing and seal assemblies operative between the drill bit body and the rotationally mounted cutter wheels.

21 Claims, 4 Drawing Figures

PRESSURE COMPENSATOR AND LUBRICATING RESERVOIR WITH IMPROVED RESPONSE TO SUBSTANTIAL PRESSURE CHANGES AND ADVERSE ENVIRONMENT

This invention relates to lubricating antifriction bearing and seal assemblies and the like in environments of changing ambient pressures. More specifically, the present invention pertains to a new and improved pressure compensator and lubrication reservoir particularly useful in earth drilling tools and in deep submergence ocean machinery such as submarines, underwater mining devices and the like, for example.

Earth drilling tools and deep submergence ocean machinery typically make use of rotating parts exposed to the particular ambient environment. The rotating parts are usually connected by bearing assemblies and lubricant is contained within the bearing assemblies by seals. Since the pressure of the ambient environment may vary substantially between the earth or sea level and the location where the equipment will eventually be used, i.e. deep in drilling fluid-filled boreholes or deep beneath the surface of the ocean, it has been recognized that the seals must remain effective under substantial pressure change differentials if the rotating parts and bearings are to avoid premature failure. Various pressure compensators and arrangements of lubricant-filled reservoirs have previously been devised, but all such equipment is subject to limitations including, among others, reduced space available for locating the compensators and reservoirs, limited response capability to adverse environmental effects and to pressure changes resulting from relatively rapid transportation between locations of substantially different pressure, substantial costs incurred in construction, the requirement for additional devices to achieve the best operability, and potential nonreliability due to premature failure.

Most of the limitations applicable to state of the art earth drilling rock bits stem from the fact that the pressure compensators and lubrication reservoirs are located within the space available in each of three forgings or castings which are machined and heat treated to form the three segments that are welded together to form the bit body. Increasing the size of the bit body segments will increase the cost of the drill bit because larger machine tools are necessary to manipulate the forgings or castings when machining bearing surfaces for the bearing assembly. The size limitations of the segments have therefore dictated that compromises be made in pressure compensator designs. Related problems are also prevalent in deep submergence ocean machinery.

Current and future increases in drilling depths dictate a need for improvements in the pressure compensating and lubricating features of drill bits, particularly drill bits for drilling six and three quarter inch diameter or smaller well bores. The expected future dependence on the resources available in and at the bottom of the ocean also suggests a substantial need for improved lubricating systems for sealed bearing assemblies and the like in deep submergence ocean machinery.

SUMMARY OF THE INVENTION

A primary objective of the present invention is to provide improved pressure compensation in lubricating systems subject to substantial pressure changes and adverse environments. In order to secure this objective, one aspect of the present invention involves a lubricant reservoir defined at least in part by a flexible wall membrane. A pressure exerting chamber is defined at least in part by a second flexible structure or membrane and is filled with gas to apply pressure to the flexible wall membrane of the lubricant reservoir. The flexible membrane of the pressure exerting chamber is exposed to the ambient environment. Changes in ambient pressure are transmitted through gas in the chamber to the lubricant in the reservoir. Lubricant is conducted from the lubricant reservoir to the bearing and seal assemblies.

The gas in the pressure exerting chamber rapidly equalizes the lubricant pressure with the pressure of the ambient environment across the seal assembly, both under transient surge conditions and continuous change conditions. As a result, the amount of foreign material from the ambient environment which is forced past the seal assembly into the lubricant is reduced or eliminated. In contrast, the typical prior art pressure compensator uses the relatively high viscosity lubricant as a pressure compensating fluid. Since the high viscosity of the lubricant substantially reduces its capability of rapidly transmitting pressure surges, the seal assemblies in such prior art arrangements must operate with a greater pressure differential which increases the friction between the seal and the relatively moving parts. Increased friction diminishes the effective life of the seal assembly, and hence the bearing assembly and the equipment in which the bearing assembly is operative. In addition to eliminating the problem of relatively sluggish pressure equalization, the gas-filled pressure exerting chamber of the present invention also functions as an accumulator to absorb or dampen pressure surges. Damage from hydraulic hammering created by pressure surges is thereby greatly minimized or avoided altogether.

Another objective of the present invention is to provide a lubricating system for earth drilling rock bits which is more effective in maintaining minimal or no pressure differential across the seal assembly of the cutter wheel bearing under changing pressure conditions, which offers relatively good reliability and is less susceptible to failure, which supplies a relatively large volume of lubricant for use by the bearing assembly, which offers reduced overall costs when used in earth drilling, and which eliminates the need for certain types of prior art equipment previously regarded as necessary or highly desirable. To obtain these objectives, another aspect of the present invention involves locating the pressure exerting chamber and lubricant containing reservoir in an annular indention formed in a drill collar connected to or adjacent the drill bit. Lubricant passageways extend from the lubricant reservoir through the drill collar and bit body to the bearing assembly which rotationally connects the cutting wheels of the drill bit to the bit body. A protective cover extends around the drill collar and openings are formed through the protective cover for the purpose of transmitting ambient pressure from the annulus of the borehole to the flexible membrane of the pressure exerting chamber. The drill bit body segments need not be formed with the conventional mechanical pressure compensators and relatively small lubricant reservoirs. The volume of the lubricant reservoir positioned at the adjacent drill collar is substantially greater than the volume of a lubricant reservoir which could be formed in a segment of the drill bit body. The flexible nature of at least a portion of the pressure exerting chamber makes it less susceptible to rupturing, sticking, fouling or the like, from earth particle cuttings or other tramp solids such as broken cutter teeth. The overall costs of drilling are reduced because drill bits need not include the expensive conventional mechanical pressure compensators and lubricant reservoirs. The volume and rechargeable nature of the lubricant reservoir allow the drill collar containing the pressure exerting chamber and lubricant containing reservoir to be reused with new drill bits when the previous drill bit wears out. Since the volume of the lubricant containing reservoir is relatively large, and flexibility exists in the pressure exerting chamber, the use of relief valves employed in most prior art drill bits is unnecessary.

Specific aspects of the present invention are defined more definitely by the scope of the appended claims. A more complete understanding of the present invention and its significant advantages and improvements can be obtained from the following detailed description of its presently preferred embodiments taken in conjunction with the drawings.

DRAWINGS

PREFERRED EMBODIMENTS

Figure 1:
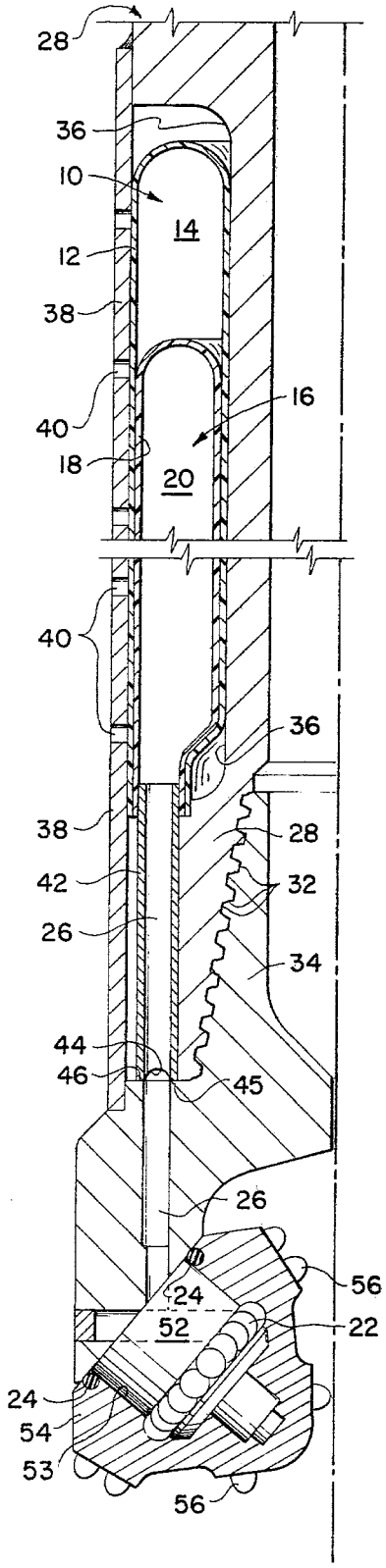
FIG. 1 illustrates one embodiment of the invention in conjunction with a drill bit and a drill collar shown in an axially sectioned and left-hand partial view.
Figure 3:
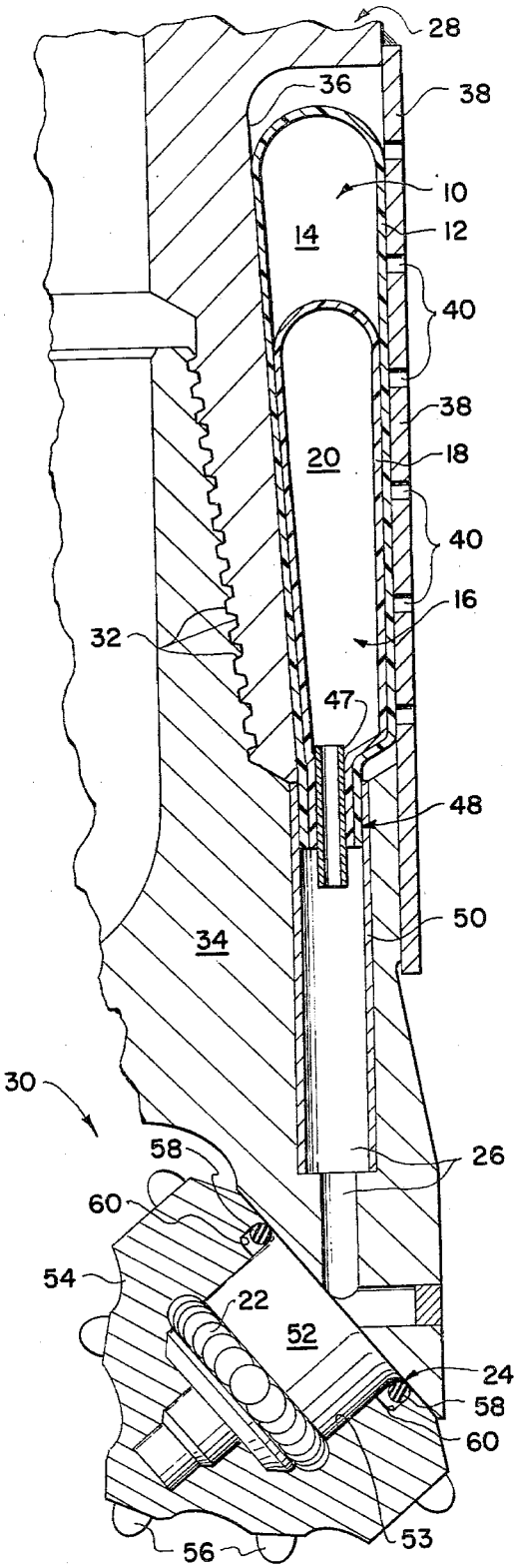
FIG. 3 is an axially sectioned and right-hand partial view similar to FIG. 1 illustrating another embodiment of the present invention.

Improved pressure compensation in a lubricating system is secured by the present invention by use of a pressure exerting chamber generally referenced 10 in FIGS. 1 and 3. The pressure exerting chamber 10 is defined at least in part by an imperforate flexible chamber wall membrane 12 which is exposed at its exterior side to the pressure of the ambient environment. Preferably, the structure of pressure exerting chamber 10 is a bladder (shown) which is wholly defined by the wall membrane 12. A charge of inert gas is hermetically sealed within the interior 14 of the chamber 10. A lubricant containing reservoir generally referenced 16 is defined at least in part and preferably wholly by an imperforate flexible reservoir wall membrane 18 which also assumes a bladder-like structure (also shown). Lubricant is contained within an interior 20 of the reservoir 16 and contacts the interior side of the wall membrane 18. The gas in the chamber interior 14 contacts the interior side of the chamber membrane 12 and the exterior side of the reservoir membrane 18. Both membranes 12 and 18 are preferably formed of elastomeric material. Ambient pressure applied to the exterior of the chamber wall membrane 12 is operatively transmitted by the interior gas throughout the chamber 10 to the flexible wall 18 of the reservoir 16.

The lubricant containing reservoir 16 is operatively isolated from pressure influences other than those applied by the chamber 10. In the embodiments shown in FIGS. 1 and 3, the lubricant containing reservoir 16 is positioned within the interior 14 of the pressure exerting chamber 10. Accordingly, the chamber 10 is defined in part by the reservoir membrane 18. However, it is sufficient if only a limited portion of the lubricant containing reservoir 16 is defined by a flexible reservoir wall membrane, and the reservoir wall membrane is operatively acted upon by the pressure effects available from the pressure exerting chamber 10.

Under the influences of ambient pressure, the gas pressure within the chamber 10 is transmitted to the lubricant contained within the reservoir 16. Lubricant is conducted between the reservoir interior 20 and a bearing assembly 22 and a seal assembly 25 by means of lubricant conducting passageways 26. The seal assembly 24, of course, operatively contains the lubricant within the bearing assembly 22 and isolates lubricant within the bearing assembly from the ambient environment. The pressure of the ambient environment is applied on the exterior surface or face of the seal assembly 24, and lubricant pressure within the bearing assembly 22 is operatively applied on the interior surface or face of the seal assembly 24. The interior surface of the seal assembly is in pressure opposition with its exterior surface. The lubricant pressure is communicated through the lubricant passageway 26 from the interior 20 of the reservoir 16. In order to prevent the ingress of destructive environmental substances such as abrasive-laden drilling fluid or caustic sea water, the objective is to maintain the interior lubricant pressure approximately equal to the ambient environmental pressure, thereby creating a zero or minimal pressure differential across the seal assembly. The flexibility of the chamber membrane 12 and the rapid pressure transferring capability available by the gas in the chamber interior 14 quickly equalizes the lubricant pressure with the ambient pressure without reliance on the sluggish pressure transferring capability of the relatively high viscosity lubricant. In other words, pressure compensation is achieved by the low viscosity inert gas contained within the chamber 10 in conjunction with the easily flexible wall membranes 12 and 18. The high viscosity lubricant need not be moved or displaced in order to achieve the desirable zero or minimal pressure differential across the seal assembly 24, as is typically required in prior art arrangements.

The embodiments of the present invention shown in FIGS. 1 and 3 are disclosed in conjunction with earth drilling apparatus in the form of a drill collar 28 and a drill bit 30. The drill collar 28 is threadably connected at 32 to the body 34 of the drill bit 30. The pressure exerting chamber 10 is preferably located within an annular indention 36 formed in the drill collar 28 at a position adjacent the end of the drill collar 28 to which the drill bit 30 is connected. The pressure exerting chamber 10 and the lubricant containing reservoir 16 shown in FIG. 1 may assume an annular configuration shown in FIG. 2. The pressure exerting chamber 10 and lubricant containing reservoir 16 shown in FIG. 3 can be formed as individual, cylinder-like units illustrated in FIG. 4. A cover plate member 38 is connected or welded to the outer exterior cylindrical surface of the drill collar 28 and shields the annular or cylinder-like configurations of the chambers 10 and reservoirs 16. Ports or openings 40 are formed through the cover member 38 for the purpose of communicating the ambient pressure to the chamber membrane 12. The other or lower end of the cover member 38 is supported against the outside exterior surface of the drill bit body 34, but is not connected thereto.

Figure 2:
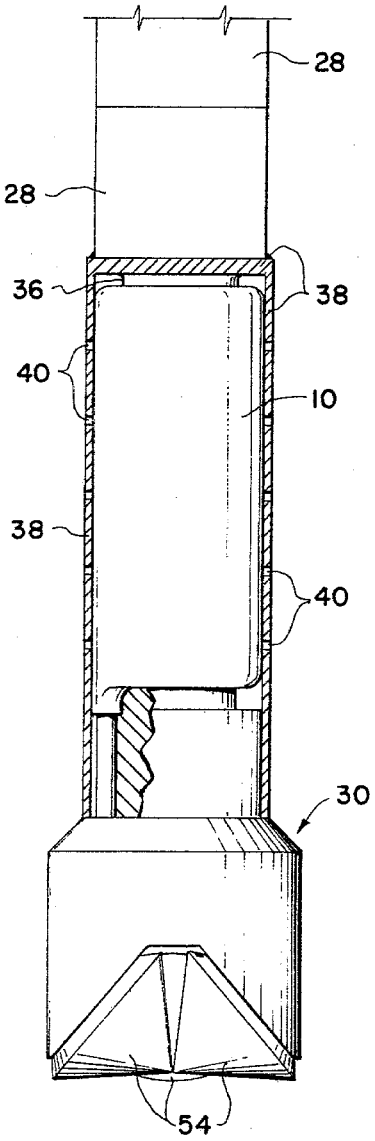
FIG. 2 is a reduced and generalized side elevational view of the drill collar and drill bit shown in FIG. 1 with a portion thereof broken away for clarity.

In the annular configuration of the pressure exerting chamber 10 and lubricant containing reservoir 16, shown in FIGS. 1 and 2, lubricant from the reservoir interior 20 is conducted in parallel flow paths to all of the bearing and seal assemblies of the drill bit, which are typically three for a conventional three cone drill bit. At least one conduit 42 extends from the reservoir interior 20 to communicate with the passageways 26 formed in the drill bit body 30 leading to each bearing assembly. The reservoir membrane 18 is sealed to the conduit 42 in a fluid-tight manner. An annular groove 44 is formed into an end shoulder 45 of the drill collar 28 at a location which will communicate with each of the passageways 26 in the drill bit body 34 leading to the individual bearing and seal assemblies of the drill bit. Although more than one conduit 42 could be provided to supply the lubricant from the reservoir 16 to the groove 44, one is sufficient in the embodiment shown in FIG. 1 because of the common connection of all passageways 26 through the annular groove 44 to the conduit 42. Of course, when the drill bit 30 is threaded onto the drill collar 28 at 32, the end shoulder 45 of the drill collar 28 adjacent the annular groove 44 contacts and seals against a shoulder 46 of the drill bit body to seal the interior of the conduit 42 and groove 44 to each passageway 26.

In the embodiment shown in FIG. 1, the pressure exerting chamber and lubricant containing reservoir are preferably permanently assembled to the drill collar 28. Assembly first proceeds by positioning the annular chamber 10 containing the annular reservoir 16 in the indention 36. The reservoir membrane 18 has preferably previously been sealed to the conduit 42, and the chamber membrane 12 has preferably previously been sealed to the reservoir membrane 16 at the location of the conduit 42 after the inert gas has been placed within the interior 14 of the chamber 10. The cover member 38 is attached to the drill collar after the pressure exerting chamber and lubricant containing reservoir have been positioned in the indention 36 and after the conduit 42 has been retained to the lower end of the drill collar 28. The lubricant containing reservoir 16 can be recharged with lubricant by attaching a lubricant fitting to the lower end of the conduit 42 and forcing lubricant into the reservoir interior 18. Recharging would, of course, occur during the time when the drill bit 30 is removed, such as when changing drill bits. Conventional valving arrangements (not shown) could be positioned within the interior of the conduit 42 to hold the lubricant within the lubricant containing reservoir 16 and conduit 42 until such time as the drill bit is connected to the drill collar. Mechanical means (also not shown) for opening the valve could be activated when the drill bit is connected to the drill collar. However, so long as the amount of lubricant introduced into the reservoir 16 does not cause the gas pressure within the chamber interior 14 to exceed the ambient pressure at the location where grease is introduced into the reservoir 16, no valving means is necessary.

Figure 4:
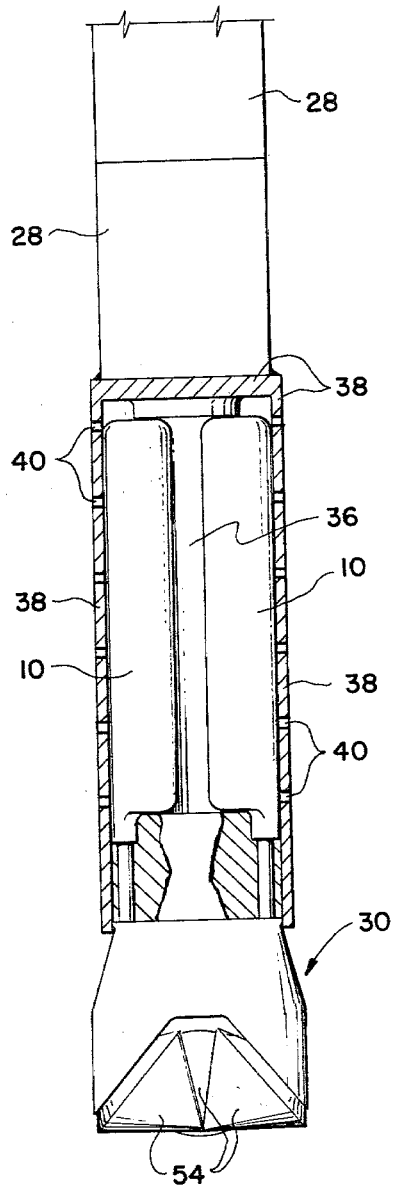
FIG. 4 is a reduced and generalized side elevational view of the drill collar and drill bit shown in FIG. 3 with a portion thereof broken away for clarity.

In the embodiment shown in FIGS. 3 and 4, a separate cylindrical unit defined by a pressure exerting chamber 10 and an interiorly contained lubricant containing reservoir 16 is provided for each bearing assembly 22 and seal assembly 24. Accordingly, in conventional three-cone drill bits, three such cylindrical units are provided. As shown in FIG. 3, a relatively short interior tube 47 extends between the reservoir interior 16 and each passageway 26. The reservoir wall membrane 18 is sealed to the exterior of the tube 47, and the chamber wall membrane 12 is sealed to the exterior of the reservoir membrane 18 at a position adjacent to the location where the membrane 18 is sealed to the tube 47. Accordingly, a plug-like configuration 48 results due to the thickness of the membranes 12 and 18 radially exterior of the tube 47. The plug-like configuration 48 is resiliently forced into the interior of the passageway 26 which may be defined at least in part by a cylindrical member 50. Accordingly, the plug-like configuration 48 seals the reservoir interior 18 through the tube 46 to the passageway 26. The three cylindrical-like chamber and reservoir units are attached to the drill bit 30 prior to threadably connecting the drill collar 28. As the drill bit and drill collar are axially aligned, the membranes defining the chamber 10 and reservoir 16 slide into the lower open end defined by the radial space between the drill collar material and the cover member 38. The cover member 38 slides over the exterior surface of the drill bit as the drill bit and drill collar are threaded together. In the embodiment shown in FIG. 3, each lubricant containing reservoir 16 can also be recharged with lubricant by forcing it through the tube 47 during a time when the chamber and reservoir units are disconnected from the drill bit 30.

The elements of the drill bit 30 are conventional and well known. The bearing assembly 22 is operative between a journal pin 52 extending from the bit body 34 and an interior load bearing surface 53 of a rotational cone-like cutter wheel 54. Cutting elements 56, such as teeth or cutting inserts, extend from the exterior surface of the cutter wheel 54 and contact and drill the earth formation when the drill bit is rotated in contact with the drill face of a well bore. Although different types of seal assemblies are used with cone wheel drill bits, the most prevalent type is an O-ring seal 58, best shown in FIG. 3. The O-ring seal 58 contacts the exterior surface of the journal pin 52 and moves within an annular groove 60 formed in the interior surface 53 of the cutter wheel 54. In prior art arrangements, the axial length, relative to the axis through the journal pin 52, of the groove 60 was very important because the O-ring 58 was required to roll or slide axially on the journal pin in order to attempt to compensate for pressure surges and transients. Prior art mechanical compensators utilizing the high viscosity lubricant as a pressure compensating fluid typically do not respond rapidly enough to compensate for and maintain the desirable zero pressure differential across the O-ring 58 under pressure transients. In prior arrangements, the O-ring 58 must actually move to attempt to achieve a minimal pressure differential. Movement of the O-ring in this manner creates frictional wear which reduces its lifetime. Such movement is eliminated or minimized as a result of the present invention.

Compensation for pressure transients is readily achieved by pressure transferring capability of the gas within pressure exerting chamber 10. The flexible nature of the chamber membrane 12 and the extremely low viscosity inert gas within the interior 14 provide an accumulator effect which damps pressure transients and pulses across the seal assembly 24. As rapid pressure changes occur, such as when quickly lowering the drill bit into a deep drilling fluid-filled well bore, the resilient pressure exerting chamber 10 quickly and accurately applies the corresponding pressure to the lubricant containing reservoir, and the lubricant pressure is quickly equalized. The compensation effects achievable by the present invention are rapid and relatively instantaneous. Prior art mechanical-type compensators are incapable of responding quickly enough to compensate for rapid pressure changes as the drill bit is moved within the well bore. It is for this primary reason that relief valves are often used in conjunction with prior art mechanical compensators. The relief valves function to expel lubricant when the mechanical compensator cannot release the interior lubricant pressure sufficiently quickly as when the drill bit is raised to the surface of the earth. The resilient nature of the reservoir membrane 18 and the relatively large volume of the reservoir allow the lubricant to contract and expand under the influences of changing pressure and temperature experienced between the different environments of use and preparation. The necessity for a prior art relief valve in order to release volume expansions is thereby eliminated. The volume of the reservoir interior 20 is substantially greater than that which can be contained within the typical prior art lubricant reservoir formed in the drill bit body segments. The larger volume of lubricant assures that the bearing assembly will be well lubricated for a longer period of time and will be less susceptible to failure due to lack of sufficient lubricant. Fouling, rupture and sticking by earth particle cuttings or other tramp solids such as broken cutter teeth is virtually eliminated due to the flexible and elastic nature of both the chamber membrane 12 and the reservoir membrane 18. Lastly, reduced costs result from using the present invention in earth drilling tools. In drilling deep well bores, a significant number of drill bits will typically be worn out before the bore is completed. Each of these drill bits typically includes three lubricant reservoirs, each with its own mechanical compensator, as well as one or more relief valves. All of this equipment adds expense to the drill bit and is not reusable since it must be discarded with the worn out drill bit. The present invention, when applied to earth drilling tools, is reusable and thereby avoids the cost of the prior art equipment integral with the drill bits. The savings in expense of the added equipment integral with drill bits more than offsets the added cost of manufacturing the drill collar 28 with the pressure exerting chamber 10, the lubricant containing reservoir 16, the cover member 38, and the other associated elements. Since many of the adverse influences present in deep submergence ocean applications are of a related nature to those present in earth drilling applications, the present invention also offers substantial improvements and advantages in deep submergence ocean applications, among others.

Preferred embodiments of the present invention have been shown and described with particularity. It should be understood, however, that the present description has been made by way of example and that the invention itself is defined by the scope of the appended claims.

What is claimed is:

1. An improved pressure compensating and lubricating apparatus for a seal assembly which has one face exposed to an ambient environment of substantially changing pressures, comprising:

means defining a reservoir for containing lubricant, said means defining the reservoir including an imperforate flexible reservoir wall membrane by which pressure is transmitted to lubricant within the reservoir;

an open passageway communicating lubricant between the reservoir and another face of the seal assembly which is in essentially pressure opposition to the face exposed to the ambient environment; and means defining a hermetically sealed chamber for operatively exerting pressure on the flexible reservoir wall membrane of the lubricant containing reservoir in response to pressure variations in the ambient environment, said means defining the chamber including: an imperforate flexible chamber wall membrane exposed on one side thereof to the ambient environment of substantially changing pressures, a predetermined charge of gas hermetically contained within the interior of the chamber and contacting the other side of the flexible chamber wall membrane, and means for transferring substantially only the pressure of the gas within the chamber to the flexible reservoir wall membrane.

2. Apparatus as recited in claim 1 wherein said means defining the hermetically sealed chamber also includes the flexible reservoir wall membrane, and the gas contained within the interior of the chamber also contacts an exterior side of the reservoir wall membrane.

3. Apparatus as recited in claims 1 or 2 wherein said lubricant containing reservoir is substantially totally contained within the interior of the pressure exerting chamber.

4. Apparatus as recited in claims 1 or 2 wherein the extent of flexibility of the reservoir wall membrane is sufficient to attain volume changes of the lubricant containing reservoir to accommodate changes in lubricant volume caused by pressure and temperature changes encountered in the different environments of use and preparation for use of said apparatus.

5. Apparatus as recited in claim 1 wherein the flexible reservoir wall membrane substantially defines a bladder-like structure for said lubricant containing reservoir.

6. Apparatus as recited in claim 1 wherein the flexible chamber wall membrane substantially defines a bladder-like structure for said pressure exerting chamber.

7. An improved pressure compensating and lubricating apparatus for a seal assembly which has one face exposed to an ambient environment of substantially changing pressures, comprising:

means defining a reservoir for containing lubricant, said means defining the reservoir including an imperforate flexible reservoir wall membrane by which pressure is transmitted to lubricant within the reservoir;

a passageway communicating lubricant between the reservoir and another face of the seal assembly which is in essentially pressure opposition to the face exposed to the ambient environment; and means defining a hermetically sealed chamber for operatively exerting pressure on the flexible reservoir wall membrane of the lubricant containing reservoir, said means defining the chamber including: an imperforate flexible chamber wall membrane exposed on one side thereof to the ambient environment of substantially changing pressures, the flexible chamber wall membrane substantially defining a bladder-like structure for said pressure exerting chamber, a predetermined charge of gas hermetically contained within the interior of the chamber and contacting the other side of the flexible chamber wall membrane, and means for transferring substantially only the pressure of the gas within the chamber to the flexible reservoir wall membrane.

8. Apparatus as recited in claims 1, 2 or 7 in combination with a bearing assembly operative between two relatively rotating parts, said passageway also communicating lubricant to the bearing assembly, and the seal assembly operatively separating the lubricant within the bearing assembly from the ambient environment.

9. Apparatus as recited in claim 8 in combination with an earth drilling drill bit and a drill collar adapted to be connected to the drill bit, said drill bit including a rotational cutter wheel and a bit body, the bearing assembly and the seal assembly operative between the cutter wheel and the bit body, said means defining the reservoir and said means defining the chamber both substantially positioned on the drill collar, and said passageway extending from the drill collar through the bit body.

10. Apparatus as recited in claim 9 wherein the extent of flexibility of the reservoir wall membrane is sufficient to attain volume changes of the lubricant containing reservoir to accommodate changes in lubricant volume caused by pressure and temperature changes encountered between the bottom of a well bore being drilled and the surface location from which the well bore was originated.

11. Apparatus as recited in claim 8 in combination with at least one of earth drilling apparatus or deep submergence ocean machinery.

12. Apparatus as recited in claims 6 or 7 wherein the lubricant containing reservoir is defined by a flexible impervious bladder structure.

13. Apparatus as recited in claims 1, 2 or 7 wherein said chamber wall membrane comprises an elastomer material.

14. In earth drilling apparatus comprising a drilling tool having a pair of relatively moveable parts positioned for operative contact with an ambient environment of drilling fluid and particle cuttings carried by the drilling fluid, a drill string to which the drilling tool is operatively connected, the drill string including at least one drill collar, a lubricated bearing assembly operative between the pair of relatively moveable parts, a lubricant seal assembly operative between the pair of relatively moveable parts for isolating lubricant within the bearing assembly from the drilling fluid and particle cuttings, a passageway communicating lubricant to the bearing assembly, a lubricant containing reservoir supplying lubricant to the passageway, and an improved pressure compensator apparatus comprising:

an imperforate flexible reservoir wall membrane defining at least a part of the lubricant containing reservoir, said reservoir wall membrane operatively deflecting under pressure to vary the volume of lubricant contained within the reservoir; and a gas filled and hermetically sealed chamber operatively positioned for solely communicating pressure to the reservoir wall membrane substantially in accordance with the ambient environment pressure.

15. Apparatus as recited in claim 14 wherein said chamber is defined at least in part by said reservoir well membrane.

16. Apparatus as recited in claim 15 wherein said improved pressure compensator apparatus comprises:

means substantially locating the lubricant containing reservoir and the chamber on the drill collar.

17. Apparatus as recited in claim 16 wherein said drilling tool comprises a drill bit having at least one cutter wheel rotationally mounted to a drill body, one cutter wheel and the drill bit body defining one pair of relatively moveable parts, one seal assembly and one bearing assembly operative between each cutter wheel and the drill bit body, the drill bit body being operatively connected to the drill collar, and the passageway extending from the drill collar into the drill bit body.

18. Apparatus as recited in claim 17 wherein said chamber and said reservoir are positioned within an indention formed into the drill collar from an exterior surface thereof.

19. Apparatus as recited in claim 18 further comprising a cover member extending over the indention, the cover member having openings formed therein for communicating ambient pressure to the chamber.

20. Apparatus as recited in claim 18 wherein said drill bit includes a plurality of cutter wheels rotationally mounted to the bit body and a separate passageway extending through the bit body to each bearing assembly of each cutter wheel, and wherein said improved pressure compensator apparatus further comprises:

a separate lubricant containing reservoir connected to each passageway, and a chamber operatively and separately associated with each reservoir.

21. Apparatus as recited in claims 14, 15, 16, 17 or 20 wherein said chamber is defined at least in part by an imperforate flexible bladder structure in pressure communication with the ambient environment.

* * * * *